US010281140B2

(12) United States Patent
Robertson et al.

(10) Patent No.: US 10,281,140 B2
(45) Date of Patent: May 7, 2019

(54) LOW NOX COMBUSTION METHOD AND APPARATUS

(71) Applicant: Chevron U.S.A. Inc., San Ramon, CA (US)

(72) Inventors: Thomas F. Robertson, Medina, OH (US); John J. Nowakowski, Richfield, OH (US); Mark C. Hannum, Hudson, OH (US); Stein J. Storslett, Bakersfield, CA (US)

(73) Assignee: CHEVRON U.S.A. INC., San Ramon, CA (US)

( * ) Notice: Subject to any disclaimer, the term of this patent is extended or adjusted under 35 U.S.C. 154(b) by 455 days.

(21) Appl. No.: 14/799,091

(22) Filed: Jul. 14, 2015

(65) Prior Publication Data

US 2016/0018102 A1 Jan. 21, 2016

Related U.S. Application Data

(60) Provisional application No. 62/022,469, filed on Jul. 15, 2014.

(51) Int. Cl.

| | |
|---|---|
| ***F23C 5/08*** | (2006.01) |
| ***F23C 6/04*** | (2006.01) |
| ***F23C 9/08*** | (2006.01) |

(52) U.S. Cl.

CPC ..... *F23C 9/08* (2013.01); *F23C 5/08* (2013.01); *F23C 6/047* (2013.01); *F23C 2202/20* (2013.01)

(58) Field of Classification Search

CPC .. F23C 6/047; F23C 9/003; F23C 9/08; F23C 2202/20

See application file for complete search history.

(56) References Cited

U.S. PATENT DOCUMENTS

| | | | |
|---|---|---|---|
| 3,890,084 | A | 6/1975 | Voorheis |
| 4,137,806 | A | 2/1979 | Segal |
| 4,257,763 | A | 3/1981 | Reed |
| 4,277,942 | A | 7/1981 | Egnell |
| 4,412,810 | A | 11/1983 | Izuha |
| 4,435,148 | A | 3/1984 | Moss |
| 4,488,869 | A | 12/1984 | Voorheis |
| 4,609,342 | A | 9/1986 | Showalter |
| 4,616,994 | A | 10/1986 | Tomlinson |
| 4,797,087 | A | 1/1989 | Gitman |

(Continued)

OTHER PUBLICATIONS

Thornock, J.N., et al.; "Evaluating the NOx Performance of a Steam Generator for Heavy Oil Production: Impact of Combustion System Design"; Jul. 17, 2014, pp. 1-22.

*Primary Examiner* — David J Laux

(74) *Attorney, Agent, or Firm* — Karen R. DiDomenicis

(57) ABSTRACT

A steam generator system employing a fired burner with a flue gas recirculation system with low NOx emission is disclosed. A method to retrofit fired burners for low NOx emission is also disclosed. In the system, the flue gas recirculation system is configured to include a pre-mixer, and the recirculated flue gas (RFG) is routed to the stage of the pre-mixer for mixing with a portion of the fuel stream, forming a secondary RFG fuel mixture. The secondary RFG fuel mixture is routed to the secondary stage of the burner via a plurality of injector ports. The injection of the second RFG fuel mixture results in a reduction of temperature for the NOx emission to be less than 5 ppm at 3% $O_2$, dry basis.

21 Claims, 13 Drawing Sheets

(56) References Cited

U.S. PATENT DOCUMENTS 4,852,523 A 8/1989 Zeimes
4,856,492 A 8/1989 Kawamoto
4,867,674 A 9/1989 Keller
4,870,947 A 10/1989 Kawamoto
4,907,962 A 3/1990 Azuhata
4,932,337 A 6/1990 Breen
4,960,059 A 10/1990 Berkau
4,991,520 A 2/1991 Tsumura
5,067,419 A 11/1991 Kobayashi
5,073,106 A 12/1991 Toyonaga
5,098,282 A 3/1992 Schwartz
5,141,432 A 8/1992 Bell
5,197,415 A 3/1993 Stretch
5,201,650 A 4/1993 Johnson
5,205,226 A 4/1993 Kitto, Jr.
5,222,476 A 6/1993 Chmielewski
5,224,855 A 7/1993 Toyonaga
5,236,327 A 8/1993 Flanagan
5,238,395 A 8/1993 Schwartz
5,240,411 A 8/1993 Abalos
5,249,535 A 10/1993 Chung
5,259,342 A 11/1993 Brady
5,271,729 A 12/1993 Gensler
5,275,552 A 1/1994 Schwartz
5,275,554 A 1/1994 Faulkner
5,281,129 A 1/1994 Urushidani
5,297,959 A 3/1994 Hemsath
5,299,930 A 4/1994 Weidman
5,344,307 A 9/1994 Schwartz
5,356,487 A 10/1994 Goldstein
5,385,467 A 1/1995 Sebastiani
5,388,536 A 2/1995 Chung
5,403,181 A 4/1995 Tanaka
5,407,345 A 4/1995 Robertson
5,407,347 A 4/1995 Bortz
5,408,984 A 4/1995 Maughan
5,411,394 A 5/1995 Beer
5,417,927 A 5/1995 Houston
5,433,174 A 7/1995 Brady
5,439,372 A 8/1995 Duret
5,441,403 A 8/1995 Tanaka
5,445,516 A 8/1995 Stouffer
5,460,512 A 10/1995 Lifshits
5,460,513 A 10/1995 Flanagan
5,466,148 A 11/1995 Witteveen
5,472,339 A 12/1995 Rakowski
5,480,298 A 1/1996 Brown
5,516,280 A 5/1996 Kostiuk
5,535,686 A 7/1996 Chung
5,554,021 A 9/1996 Robertson
5,558,047 A 9/1996 Vetterick
5,570,679 A 11/1996 Wunning
5,573,391 A 11/1996 Benson et al.
5,575,243 A 11/1996 Vetterick
5,588,379 A 12/1996 Witteveen
5,603,906 A 2/1997 Lang
5,605,452 A 2/1997 Robertson
5,626,088 A 5/1997 Hiltunen
5,634,785 A * 6/1997 Bury ..... F23C 6/047 431/116
5,638,773 A 6/1997 Brady
5,645,412 A 7/1997 Besik
5,658,139 A 8/1997 Flanagan
5,667,374 A 9/1997 Nutcher
5,667,376 A 9/1997 Robertson
5,676,538 A 10/1997 Lovett
5,688,115 A 11/1997 Johnson
5,699,756 A 12/1997 Ross
5,711,661 A 1/1998 Kushch
5,730,591 A 3/1998 Robertson
5,772,421 A 6/1998 Besik
5,791,298 A 8/1998 Rodgers
5,806,443 A 9/1998 Kobayashi
5,810,471 A 9/1998 Nath
5,813,846 A 9/1998 Newby
5,823,764 A 10/1998 Alberti
5,826,569 A 10/1998 Voorhis
5,846,067 A 12/1998 Nishiyama
5,857,846 A 1/1999 Sattelmayer
5,863,192 A 1/1999 Motegi
5,871,343 A 2/1999 Baukal
5,908,003 A * 6/1999 Hura ..... F23C 1/12 110/210
5,915,954 A 6/1999 Rodgers
5,921,766 A 7/1999 Dobbeling
5,931,653 A 8/1999 Nakamachi
5,957,682 A 9/1999 Kamal
6,000,930 A 12/1999 Kelly
6,019,596 A 2/2000 Knopfel
6,039,560 A 3/2000 Kubota
6,206,686 B1 3/2001 Nieszczur
6,287,111 B1 9/2001 Gensler
6,289,851 B1 * 9/2001 Rabovitser ..... F22B 31/04 122/240.2
6,431,859 B1 8/2002 Neville
6,485,289 B1 11/2002 Kelly
6,604,474 B2 8/2003 Zamansky
6,609,376 B2 8/2003 Rokke
6,631,614 B2 10/2003 Mandai
6,638,061 B1 10/2003 Cain
6,659,762 B2 12/2003 Borders
6,672,862 B2 1/2004 Neville
6,705,855 B2 3/2004 Nagayama
6,736,635 B1 5/2004 Takemura
6,761,134 B1 7/2004 Trant
6,773,256 B2 8/2004 Joshi
6,796,789 B1 9/2004 Gibson
6,889,495 B2 5/2005 Hayashi
6,929,470 B1 8/2005 Lifshits
6,994,056 B1 2/2006 Boros
7,040,258 B2 5/2006 Peart
7,112,060 B2 9/2006 Takemura
7,162,864 B1 1/2007 Schefer
7,264,466 B2 9/2007 Miller
7,282,172 B2 10/2007 Hugens, Jr.
7,402,038 B2 7/2008 Neville
7,402,039 B1 7/2008 McElroy
7,452,400 B2 11/2008 Robertson
7,473,297 B2 1/2009 Hugens, Jr.
7,497,682 B2 3/2009 Kaczenski
7,537,743 B2 5/2009 Higgins
7,578,962 B2 8/2009 Robertson
7,631,640 B2 12/2009 Hofbauer
7,637,739 B2 12/2009 Nowakowski
7,666,345 B2 2/2010 Robertson
7,832,365 B2 11/2010 Hannum
7,837,462 B2 11/2010 Neville
7,913,632 B2 3/2011 Jia
8,002,541 B2 8/2011 Neville
8,033,254 B2 10/2011 Hannum
8,083,517 B2 12/2011 Newby
8,087,930 B2 1/2012 Nowakowski
8,113,821 B2 2/2012 Feese
8,167,610 B2 5/2012 Raleigh
8,177,867 B2 5/2012 Joseph
8,202,470 B2 6/2012 Cain
8,578,868 B2 * 11/2013 Taniguchi ..... F23C 9/003 110/204
8,607,572 B2 12/2013 Koizumi
8,662,887 B2 3/2014 Cain
8,726,851 B2 5/2014 Geelen
8,794,960 B2 8/2014 Lifshits
8,961,169 B2 2/2015 Newby
9,476,589 B2 10/2016 Newby
9,909,755 B2 3/2018 Robertson et al.
2001/0010896 A1 8/2001 Nagayama
2001/0022088 A1 9/2001 Mandai
2002/0166484 A1 11/2002 Zamansky
2002/0197574 A1 * 12/2002 Jones ..... F23C 6/047 431/8
2003/0054301 A1 3/2003 Borders
2003/0074885 A1 4/2003 Rokke
2003/0075214 A1 4/2003 Fraas
2003/0140619 A1 7/2003 Lindskog

(56) References Cited

U.S. PATENT DOCUMENTS

2003/0148236 A1 8/2003 Joshi
2003/0167771 A1 9/2003 Hayashi
2004/0191142 A1 9/2004 Takemura
2004/0250549 A1 12/2004 Liebe
2005/0161868 A1 7/2005 Hugens
2005/0180904 A1 8/2005 Higgins
2005/0239005 A1 10/2005 Lugnet
2006/0003275 A1 1/2006 Oehm
2006/0070585 A1 4/2006 Peart
2006/0191451 A1 8/2006 Jia
2006/0230996 A1 10/2006 Kaczenski
2007/0031768 A1 2/2007 Schefer
2007/0048679 A1* 3/2007 Joshi ..... F23C 6/047 431/8
2007/0269758 A1 11/2007 Hofbauer
2008/0096146 A1 4/2008 Li
2008/0213715 A1 9/2008 Stephens
2008/0220383 A1 9/2008 Neville
2008/0250990 A1 10/2008 Jia
2008/0264033 A1* 10/2008 Lacy ..... F23R 3/286 60/39.49
2008/0264310 A1 10/2008 Jia
2008/0279741 A1 11/2008 Golden
2009/0120338 A1 5/2009 Adendorff
2009/0226852 A1 9/2009 Feese
2010/0083884 A1 4/2010 Olin-Nunez
2010/0146984 A1 6/2010 Carroni
2010/0192580 A1 8/2010 Simons
2010/0282186 A1 11/2010 Geelen
2010/0304314 A1 12/2010 Rouchy
2010/0310998 A1 12/2010 Raleigh
2011/0027731 A1 2/2011 Neville
2011/0094239 A1 4/2011 Koizumi
2011/0138815 A1 6/2011 Headland
2011/0151389 A1 6/2011 Cattaneo
2011/0185703 A1 8/2011 Dodo
2011/0203163 A1 8/2011 Joseph
2011/0244405 A1 10/2011 Hucsko
2012/0135360 A1 5/2012 Hannum
2012/0152158 A1 6/2012 Matsumoto
2012/0178032 A1 7/2012 Roy
2012/0180774 A1 7/2012 Reifel
2012/0242980 A1 9/2012 Russell
2012/0251960 A1 10/2012 Newby
2012/0288810 A1 11/2012 Cain
2012/0315584 A1 12/2012 Astesiano
2013/0074396 A1 3/2013 Núñez
2013/0098350 A1 4/2013 Jones
2013/0203003 A1 8/2013 Cain
2014/0272736 A1* 9/2014 Robertson ..... F23C 6/047 431/12
2014/0272737 A1 9/2014 Robertson
2015/0050605 A1 2/2015 Desi-Seulean
2015/0079524 A1 3/2015 Colannino
2015/0140498 A1 5/2015 Colannino

* cited by examiner

Figure 6 Prior Art

LOW NOX COMBUSTION METHOD AND APPARATUS

CROSS REFERENCE TO RELATED APPLICATIONS

This application claims benefit under 35 USC 119 of U.S. Provisional Patent Application No. 62/024,689 with a filing date of Jul. 15, 2014. This application claims priority to and benefits from the foregoing, the disclosure of which is incorporated herein by reference.

TECHNICAL FIELD

This technology relates to a heating system in which combustion produces oxides of nitrogen (NOx), and specifically relates to a method and apparatus for suppressing the production of NOx.

BACKGROUND

Certain industrial processes, such as heating a load in a furnace or generating steam in a boiler, rely on heat produced by the combustion of fuel and oxidant in a combustion chamber. The fuel is typically natural gas. The oxidant is typically air, vitiated air or air enriched with oxygen. Combustion of the fuel and oxidant in the combustion chamber causes NOx to result from the combination of oxygen and nitrogen. It may be desirable to suppress the resulting emission of NOx in the products of combustion (flue gas).

Flue gas recirculation (FGR) is known as a technique to lower NOx emission from burners. One approach is to use the combustion air blower to recycle some amount of the flue gas from the exhaust stack and to mix it with ambient air before delivery into the burner. Another approach is to use a separate blower to recycle the flue gases from the exhaust stack and introduce them into the furnace.

Some once-through steam generators (OTSGs) in the prior art employ fired burners with flue gas recirculation ("FGR") by inducing products of combustion ("POC") into the flame from the furnace. Some fired burners employ the FGR technique by using the POC from the exhaust system to mix with gas or fuel which reduces flame temperature. Some employ the FGR technique along with fuel staging to reduce NOx. These are often referred to as ultra-low-NOx burners (ULNBs). In ULNBs, flue gas is internally recirculated using the pressure energy of fuel gas, which dilutes the fuel/air mixture and results in lower burning rates and reduced flame temperatures and subsequently, lower NOx emission levels.

The normal solution in the prior art to reduce the NOx emission of OTSG's is by complete replacement of the burner, and installation of larger than current combustion air blower to support the need for the addition of 15 to 30% FGR, as well as additional system retrofits and installation of additional system instrumentation.

There is a need for improved FGR techniques and burners that result in optimal NOx reduction, e.g., less than 5 ppm level. There is also a need for low cost methods to retrofit existing burners, including ULNBs, for optimal NOx reduction.

SUMMARY OF THE INVENTION

In one aspect, the invention relates to a burner system having low NOx emission of less than 5 ppm dry gas volumetric basis corrected to 3% $O_2$ (i.e., <5 ppm at 3% $O_2$, dry basis). The burner system comprises: a structure defining a combustion chamber; sources of primary fuel, combustion air, and secondary fuel; a premix burner having a port facing into the combustion chamber; a flue that draws products of combustion from the combustion chamber; a plurality of staged fuel injectors each having a port facing into the combustion chamber, wherein the staged fuel injectors are circumferentially arranged adjacent to and around the premix burner port; a premix injection apparatus configured to inject an unignited premix of secondary fuel and flue gas into the combustion chamber through the plurality of staged fuel injectors; a reactant supply and control system including means for conveying primary fuel from the primary fuel source to the premix burner, means for conveying combustion air from the combustion air source to the premix burner for mixing with the primary fuel, means for conveying secondary fuel from the secondary fuel source to the premix injection apparatus, and means for conveying flue gas from the flue to the injection apparatus for mixing with the secondary fuel.

In a second aspect, the invention relates to a method for operating a burner system to reduce its NOx emission. The method comprises: feeding a fuel stream and an air stream to a pre-mixer, wherein the fuel and air streams are mixed to form a first mixture at a fuel to air equivalence ratio of less than 1; injecting the first fuel air mixture via at least a primary port into a primary combustion zone of a combustion chamber, wherein the first fuel air mixture is substantially combusted forming primary products of combustion ("POC"); introducing the primary POC into a secondary combustion zone of the combustion chamber; feeding a second fuel stream and a stream of recirculated flue gas (RFG) to a pre-mixer, wherein the second fuel and recirculated flue gas streams are mixed to form a second fuel mixture; injecting the second fuel mixture into the secondary combustion zone of the combustion chamber via a plurality of injectors circumferentially arranged about the primary port; wherein the second fuel mixture is substantially combusted forming secondary POC; recirculating a portion of the combined primary POC and secondary POC for use as the RFG for mixing with the second fuel stream in premixer; wherein the injection of the second fuel mixture into the secondary combustion zone of the combustion chamber results in a reduction of temperature in the combustion chamber for the NOx emission to be less than 5 ppm.

In a third aspect, the invention relates to a method of retrofitting a steam generator employing at least a fired burner with a flue gas recirculation system, wherein a recirculated flue gas (RFG) is injected with a fuel stream into a primary stage of the burner, the retrofit is to reduce NOx emission to less than 5 ppm. The method comprises: configuring the existing flue gas recirculation system to include a pre-mixer; routing the RFG from the primary stage to the pre-mixer for mixing with a portion of the fuel stream forming a secondary RFG fuel mixture; routing the secondary RFG fuel mixture to an existing secondary stage of the burner via a plurality of injectors for the injection of the second RFG fuel mixture results in a reduction of temperature for the NOx emission to be less than 5 ppm.

DETAILED DESCRIPTION

Figure 1:
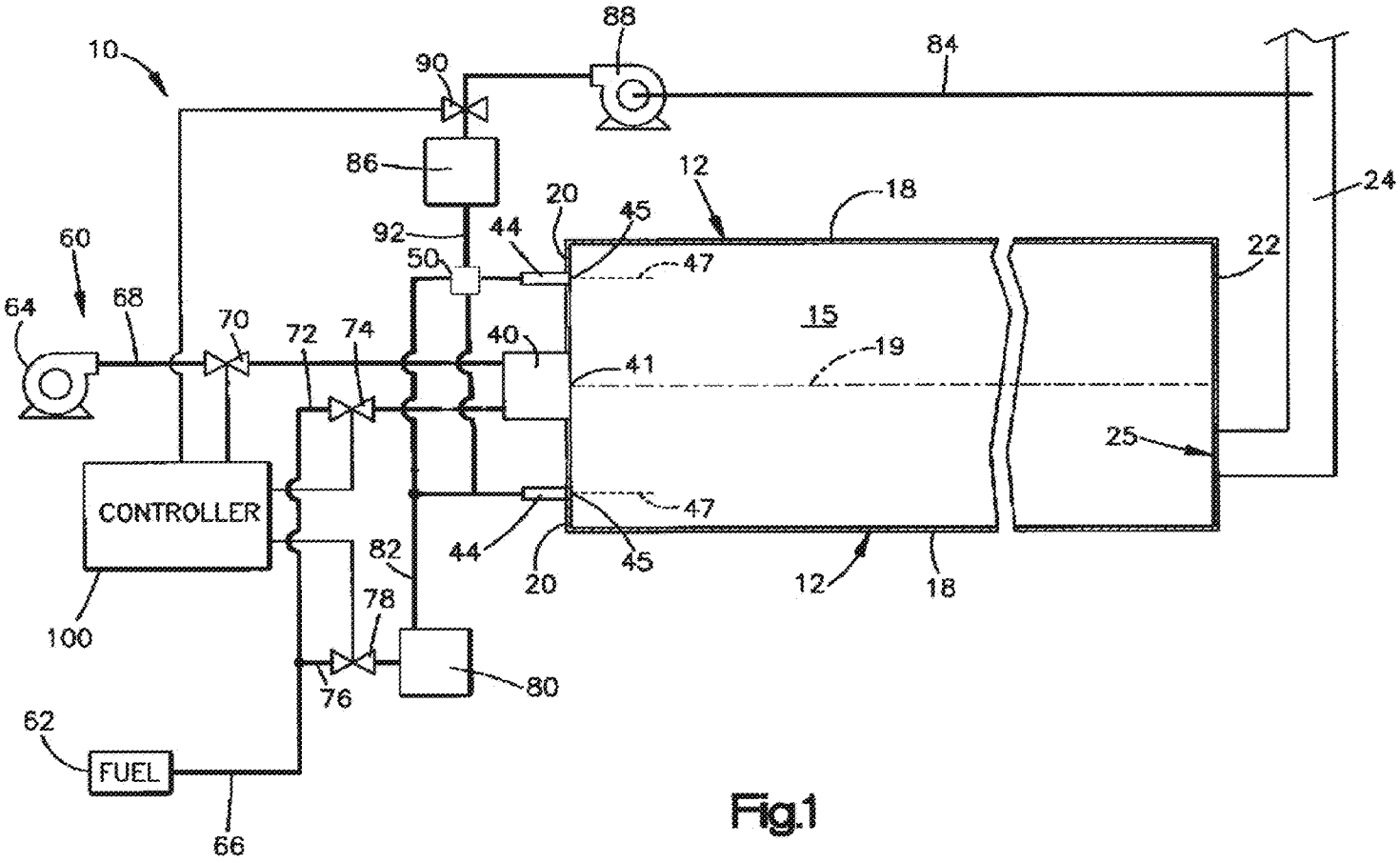
FIG. 1 is a schematic view of an embodiment of a heating system of the invention.

As used through this specification and in the claims, the term "air" or "combustion air" is used interchangeable with the term "oxidant," meaning atmospheric air, oxygen, oxygen enriched air, another suitable oxidant or combinations thereof can be used to form a combustible mixture with a fuel, such as natural gas, propane, refinery fuel gas, and the like.

The term "fuel" refers to fuels (primary constituent comprising hydrocarbons), which can be in a gaseous, liquid or solid state. Examples include natural gas (e.g., methane, propane, etc.), sour gas, waste gas, and mixtures thereof. The terms sour gas and waste gas refer to fuels containing some proportion of either, or both, $H_2S$ and carbon dioxide ($CO_2$) constituents, these terms are often interchangeable and are typically differentiated based upon the heating value of the fuel, lower heating value fuels are often described as waste gas.

"Fuel staging" refers to the combustion in burners in two or more stages, e.g., one stage being fuel-rich and the other stage(s) being fuel lean. In fuel staging, fuel gas is injected into the combustion zone in multiple stages (e.g., primary and secondary), creating fuel lean zone and delaying rate of combustion completion. The staging keeps combustion away from the stoichiometric mixture of fuel and air where flame temperature peaks. The secondary fuel can be the same or a different type of fuel as the primary fuel, with the amount of secondary fuel to primary fuel in the system ranging from 0:100 to 50:50. Combustion staging can be accomplished by air staging or fuel staging with a premix staged combustion burner. Fuel staging is best suited for fuel gas-fired burners. In some embodiment, one or more stage is added with the same or different fuel from the fuel going into the primary and/or secondary stage, e.g., the use of waste gas for the tertiary stage.

A reference to NOx emission concentration of less than 5 ppm refers to NOx emission concentration of <5 ppm at 3% $O_2$, dry basis.

The primary fuel has a higher heating value of 500 to 1200 Btu/scf in one embodiment; and from 900 to 1180 Btu/scf in a second embodiment. The secondary fuel has a higher heating value of 500 to 1200 Btu/scf in one embodiment; and a higher heating value of 900 to 1180 Btu/scf in another embodiment. In one embodiment, the primary fuel and the secondary fuel have different higher heating values. In one embodiment, the primary fuel and the secondary fuel are configured to have a volumetric ratio resulting in a primary zone adiabatic flame temperature less than 2600° F. (1427° C.); and a primary zone adiabatic flame temperature less than 2500° F. (1371° C.) in yet another embodiment.

In one embodiment of the invention, a method to retrofit existing burners, including ULNBs, is disclosed, with minimal changes to existing burner equipment or controls, and minimal impact to the existing flame detection systems/burner management systems (BMS), for a NOx emission of less than 5 ppm. In another embodiment, the method allows for the decoupling of the FGR control equipment, allowing the existing burners to function the same way and reducing FGR control functionality to simple loop control with little or no impact on internal burner fuel/air ratios.

In one embodiment, the steam generators and burners equipped are retrofitted to handle flue gas recirculation (FGR) and minimize NOx emission in a scheme called "Large-Scale Staged Recirculation" (LSR). In this LSR system, the FGR is not routed through either the combustion air blower or the burner itself. Rather the FGR is driven by a smaller, dedicated FGR blower, and is delivered to the furnace via discrete injection ports (injectors). The FGR is premixed (e.g. with a fuel stream in a premix/diffusion tube (pre-mixer), or equipment known in the art), and the premixed stream is then introduced into the furnace. In one embodiment, the system comprises a (premix) injection apparatus configured with a plurality of fuel injectors to inject unignited premix of FGR and fuel into the furnace chamber without stabilization. In the absence of a stabilized flame at the premix injection apparatus, the furnace can operate with diffuse combustion more uniformly throughout the furnace chamber and thus less NOx formation. In one embodiment, the injection apparatus in the system is configured to inject an unignited mixture of secondary fuel and flue gas into the combustion chamber at a controlled volume ratio for the products of combustion to have a NOx concentration of <5 ppm at 3% $O_2$, dry basis.

The amount of FGR ranges from 15-30 vol. % of the total amount of POC (flue gas). In one embodiment, the FGR is removed directly from the flue stack and mixed with the secondary stage fuel (or secondary fuel) with little or no addition of combustion air (i.e., sub-stoichiometric amount of oxygen), before being introduced into the secondary combustion region as a low momentum stream to suppress the production of NOx. The premixing of FGR with secondary stage fuel helps obviate the formation of localized high temperature regions in the furnace if FGR and secondary fuel are fed as separate streams and with separate injectors.

In one embodiment, all of the FGR is mixed with secondary reactant stream (secondary fuel). In another embodiment, the FGR is split with a portion being introduced with the secondary fuel, and a portion being introduced into the furnace with the primary fuel and/or the tertiary fuel, with the ratio of FGR going into the primary stage or the tertiary stage ranging from 0 to 40% of total FGR.

In one embodiment, the mixture of FGR and secondary stage fuel is injected into a plurality of staged gas ports positioned around the primary stage gas port(s), forming a secondary flame envelope peripherally surrounding the primary flame envelope. In one embodiment, the gas ports are positioned to aim radially inward, e.g., at an injection angle from 0 to 35 degree angle. In another embodiment, each gas port (nozzle) forms at least an orifice, e.g., from 1 to 8 orifices, each in communication with the combustion chamber. Each gas port can also be formed with an inlet tube which is directed inward toward the primary combustion zone or the primary flame envelope defined by the primary stage.

In one embodiment of a method to retrofit ULNBs (with FGR), the retrofit comprises the installation of a pre-mixer and rerouting the FGR to the pre-mixer, wherein it is mixed with the secondary fuel. The mixture is then introduced to the burner in the secondary stage. In another embodiment for the retrofit of an existing system without FGR, the retrofit is for the recirculation of a portion of the flue gas to the system as FGR, comprising the installation of an FGR blower/control system, and a pre-mixer. The FGR is mixed with the secondary fuel from a fuel distribution system in the pre-mixer prior to being injected into the combustion chamber in the secondary stage through existing injectors.

In one embodiment, at least one of the injectors is for injection of a mixture of primary fuel and the combustion air, and at least one of the injectors is for injection of a mixture of the secondary fuel and the products of combustion. In one embodiment, a sufficient amount of combustion air is provided for the POC to have an $O_2$ concentration ranging from 0.4 to 3% on a wet basis; and an $O_2$ concentration ranging from 0.75 to 1.5% on a wet basis in yet another embodiment.

In one embodiment, the injection apparatus is configured to inject an unignited mixture of secondary fuel and flue gas into the combustion chamber at a volume ratio of secondary fuel to flue gas of 1:4 to 1:20 in one embodiment; and 1:5 to 1:10 in a second embodiment. In another embodiment, the injection apparatus is configured to inject an unignited mixture of secondary fuel and flue gas into the combustion chamber through 3 to 8 staged fuel injectors; and from 4 to 6 staged fuel injectors in another embodiment. In one embodiment, the staged fuel injectors are circumferentially arranged adjacent to and around the premix staged combustion burner.

Example: The following illustrative example is intended to be non-limiting. In this example, existing secondary gas inlets to a gas-fired combustion unit to provide low-quality, high pressure wet steam for an enhanced oil recovery operation were replaced with a premixed inlet of recycled flue gas and natural gas, with the total fuel input remains the same. The flue gas was removed directly from the stack and perfectly mixed with the fuel stream before it was introduced into the secondary combustion zone of the burner through a simple open pipe. The lean primary combustion zone remains unchanged.

Experimental data were collected from the steam generator, including ambient air flow rate, temperature, and fuel flow rate, temperature, and flue gas composition. Data collection was also made in the furnace radiant section at longitudinal locations with radial measurements taken from the furnace wall to the center of the steam generator. At each location, extractive sampling was utilized to measure $O_2$, CO, NO and $NO_2$ concentrations as well as temperature and pressure.

Computational fluid dynamics (CFD) model was carried out, including simulations of the far field domain (i.e., beyond the exit of the primary fuel/oxidizer injectors for the primary combustion chamber and beyond the end of the secondary injectors in the radiant section). The simulations show that the well-mixed stream of natural gas and FGR that is fed through the injectors creates a diffuse (e.g. flame-less like) combustion zone where heat release is distributed, resulting in temperatures that are too low for thermal NOx formation in the region downstream of the secondary injectors with the local gas temperature having the strongest impact on NOx formation.

References will be made to the figures that illustrate the prior art and different embodiments of the invention. The figures include examples of how a person of ordinary skill in the art can make and use the claimed invention. It is described here to meet the enablement and best mode requirements of the patent statute without imposing limitations that are not recited in the claims. The various parts of the illustrated apparatus, as shown, described and claimed, may be of either original and/or retrofitted construction as required to accomplish any particular implementation of the invention, and all or part of each embodiment can be used in combination with all or part of any one or more of the others.

FIG. 1 refers to an embodiment of a steam generator system 10, or a boiler. The boiler apparatus includes a radiant heater 12, enclosing an elongated cylindrical combustion chamber 15, with elongated cylindrical side wall 18, a longitudinal central axis 19, and a pair of axially opposite end walls 20 and 22. Reactants (e.g., fuel, combustion air, etc.) are delivered to the combustion chamber 15 such that products of combustion generated within the chamber 15 will flow axially from the first end wall 20 to the second end wall 22, and outward to a flue 24 through an exhaust port 25 in the second end wall 22. This enables heat to be radiated outward along the length of the side wall.

A reactant supply and control system includes lines and valves to convey reactants to the combustion chamber, i.e., the premix burner 40 and fuel injectors 44. The system comprises a fuel control source 62 and a combustion air source 60, which includes an air blower 64 to provide streams of those reactants along respective supply lines 66 and 68. The combustion air supply line 68 extends directly to the premix burner 40, and has a combustion air control valve 70. In one embodiment and alternatively, an adjustable speed controller (not shown) is used in combination with the air blower 64). A first branch line 72 extends from the fuel supply line 66 to the premix burner 40, and has a primary fuel control valve 74. A second branch line 76 has a secondary fuel control valve 78, and extends from the fuel supply line 66 to a fuel distribution manifold 80. The manifold 80 provides secondary fuel to the combustion chamber through fuel distribution lines 82.

The premix burner 40 delivers the combustion air and primary fuel to a primary combustion zone of combustion chamber 15 through premix burner 40 and port 41. In one embodiment as shown, the port 41 is centered on the longitudinal central axis 19 of the chamber 15. In another embodiment, the mixture of combustion air and primary fuel is delivered through a plurality of multiple premix burners instead of the single premix burner 40, with the premix burners forming a concentric circle around the longitudinal central axis 19. In one embodiment, the premix burner is a mixing tube.

A portion of the flue gas 24 is recirculated back to the system in FGR line 84. The FGR line has a blower 88 and a control valve 90 (or alternatively, utilizes an adjustable speed controller in combination with the blower 88), distributing FGR through FGR manifold 86 and line 92. The FGR 92 is mixed with the secondary fuel from distribution lines 82 in gas pre-mixer 50, prior to being injected into a secondary combustion zone of the combustion chamber through injectors 44. In one embodiment, the gas mixing chamber is a mixing tube.

The injectors 44, two of which are shown in FIG. 1, are located adjacent to the premix burner 40. In one embodiment, the injectors are arranged in a circular array centered on the longitudinal axis 19 surrounding port 41. Each fuel injector 44 has a port 45 facing into the chamber 15 along a respective axis 47. The axes 47 of the fuel injectors 45 are parallel to the axis 19, but in one embodiment, one or more could be inclined to the axis 19 to inject secondary fuel in a skewed direction.

The system in one embodiment further comprises a controller 100, which is operatively associated the air supply and control system 60, fuel control system 62, and blower 64 and the valves 70, 74, 78 and 90 to initiate, regulate and terminate flows through the valves 70, 74, 78 and 90. Specifically, the controller 90 has combustion controls in the form of hardware and/or software for actuating the blower 64 and the valves 70, 74, 78 and 90 in a manner that can cause combustion of the reactants to proceed axially downstream through the chamber 15 in generally distinct stages. The controller 100 shown schematically in the drawings may thus comprise any suitable programmable automation controller or other control device, or combination of control devices, that is programmed or otherwise configured to perform as described and claimed.

In one embodiment, combustion air is delivered to the combustion chamber in a single stage as part of the primary fuel. In another embodiment (not shown in the figures), the combustion air is blended in with the mixture of FGR and secondary fuel. The fuel is delivered in primary and secondary stages simultaneously with delivery of the combustion air.

In operation, the controller 100 actuates the combustion air control valve 70 and the primary fuel control valve 74 to provide the premix burner 40 with a stream of combustion air and a stream of primary fuel. Those reactant streams mix together inside the premix burner 40 to form premix at a fuel to air equivalence ratio of less than 1 (i.e., fuel lean). The premix is delivered to the combustion chamber 15 as a primary reactant stream from the port 41 along the longitudinal central axis 19. Ignition of the premix occurs within the premix burner 40. This causes the primary reactant stream to form a primary combustion zone that expands radially outward from the port 41 as combustion proceeds downstream along the axis 19.

The controller 100 actuates the secondary fuel control valve 78 to provide a stream of secondary fuel through manifold 80. The controller 100 also actuates the FGR control valve 90 to provide streams of flue gas recirculation to mix with the secondary fuel in pre-mixer 50. The mixture is injected from secondary ports 45 located radially outward of the primary port 41, forming products of combustion that recirculate in the upstream corner portions of the combustion chamber 15. Auto-ignition of that combustible mixture creates a secondary combustion zone that surrounds the primary combustion zone at the upstream end portion of the chamber 15 and throughout the longitudinal length of the combustion chamber 15. With the FGR being part of the mixture, relatively lower combustion temperatures are achieved and the production of NOx is suppressed accordingly.

In one embodiment to operate the steam generator system, the controller 100 can further suppress the production of NOx by maintaining fuel-lean combustion throughout the two zones. For example, the controller 100 can actuate the valves 70, 74, and 78 to deliver fuel and combustion air to the combustion chamber 15 at target rates of delivery that together have a target fuel to oxidant ratio, with the target rate of oxidant being provided entirely by the combustion air in the primary reactant stream, and with the target rate of fuel being provided at first and second partial rates in the primary reactant stream and the secondary fuel streams, respectively.

FIGS. 2-9 are flow diagrams schematically illustrating various embodiments of heating systems in the prior art, including systems with and without flue gas recirculation ("FGR"). FIGS. 10-13 schematically illustrate how the various embodiments of heating systems in the prior art are retrofitted to reduce the NOx level to less than five parts per million on a dry gas volumetric basis corrected to 3% $O_2$ (<5 ppm at 3% $O_2$, dry basis).

Figure 2:
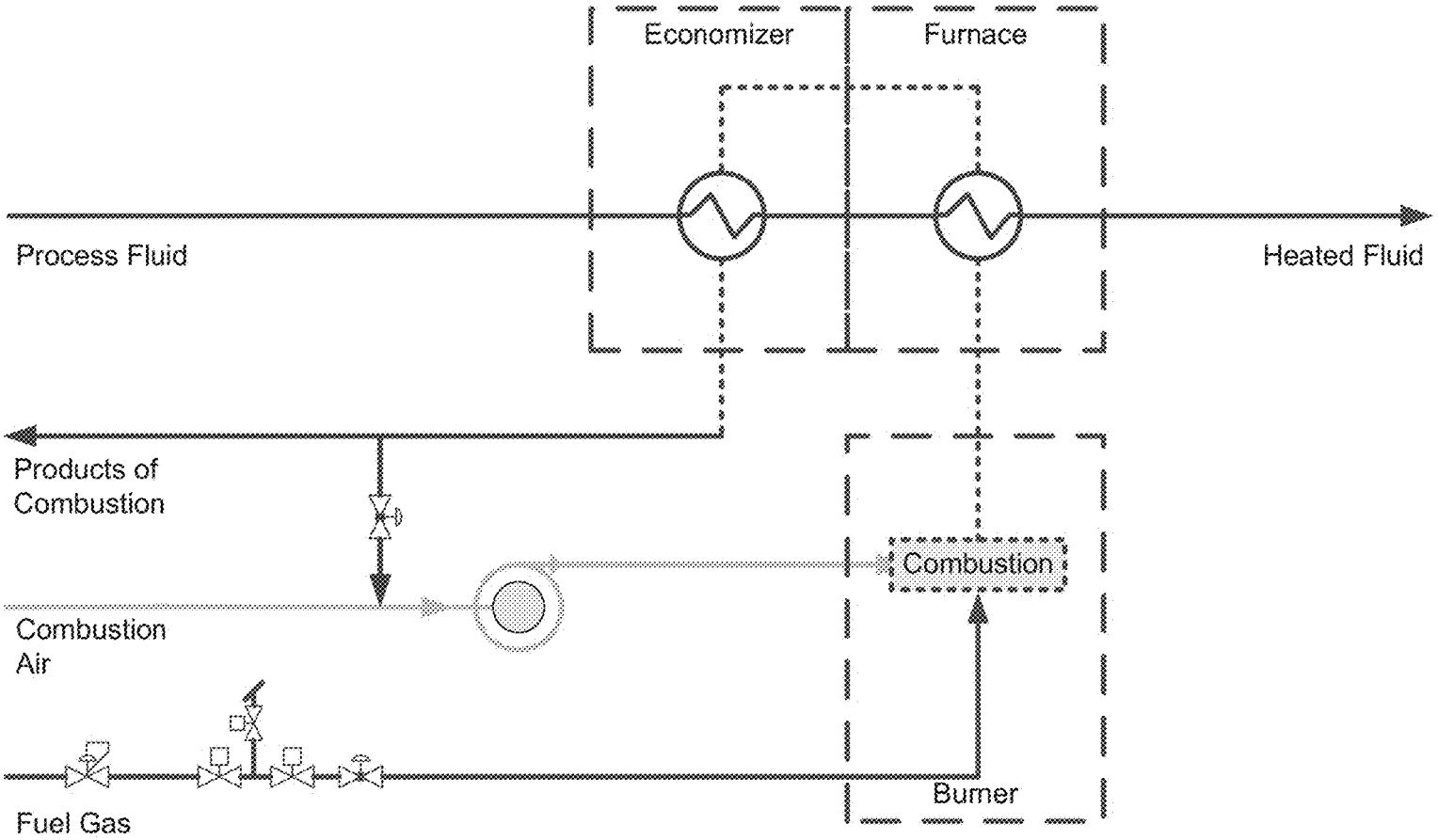
Figure 2 Prior Art
FIG. 2 is a flow diagram schematically illustrating the operation of a heating system in the prior art without any staged fuel, and with flue gas recirculation ("FGR").

FIG. 2 is a flow diagram schematically illustrating the operation of a heating system in the prior art without any staged fuel, and with flue gas recirculation ("FGR"). Combustion air and fuel are fed to a premix burner at a sub-stoichiometric fuel to air ratio having from 0.5% to 4% of excess $O_2$, to ensure complete combustion of all combustible fuel constituents. The mixture is fed into the combustion chamber where the fuel is substantially combusted, producing a combustion chamber jet to heat a process fluid (e.g., water to produce steam) and products of combustion ("POC") or flue gas which goes to flue stack.

Figure 3:
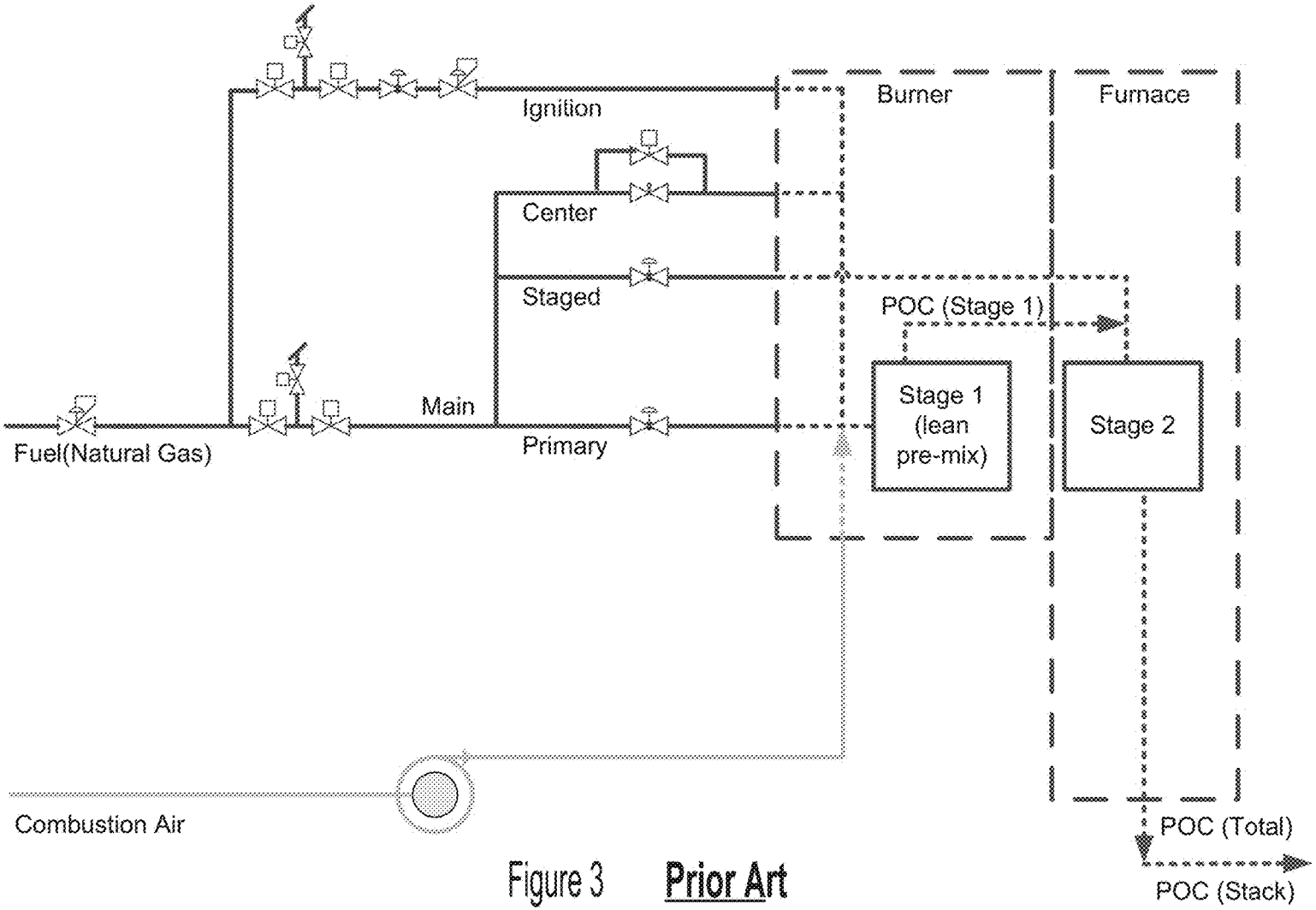
Figure 3 Prior Art
FIG. 3 is a flow diagram schematically illustrating the operation of a heating system in the prior art with staged fuel and without FGR.

FIG. 3 is a flow diagram of a heating system in the prior art without flue gas recirculation ("FGR"), but with staged fuel, wherein a portion of the fuel source is directed to a second stage. Combustion air and fuel are fed to a premix burner in the first stage at a fuel lean ratio (e.g. a fuel to air ratio of less than 1, ranging from 0.4 to 0.7). The products of combustion ("POC") or flue gas from the first stage is induced into the second stage. All of POC is directed to the exhaust stack.

Figure 4:
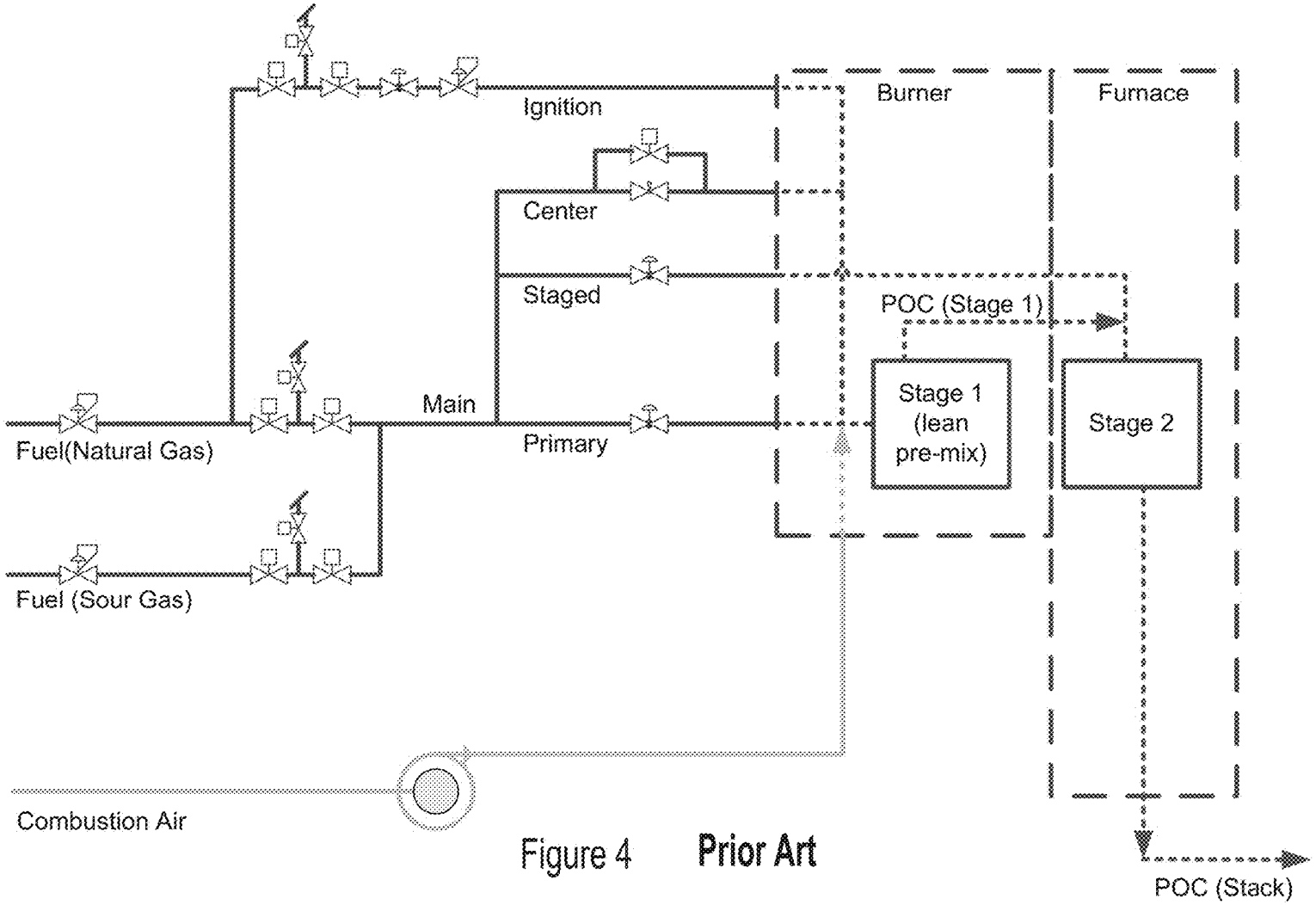
Figure 4 Prior Art
FIG. 4 is a flow diagram schematically illustrating the operation of a heating system in the prior art with staged fuel, without FGR, and with the fuel system comprising natural gas and sour gas.

FIG. 4 is a flow diagram of a variation of the prior art heating system in FIG. 3, wherein sour gas provides a portion the total fuel source to both stages of the heating system. In one embodiment, the amount of sour gas provides from zero (0%) to 100% total fuel to the system.

Figure 5:
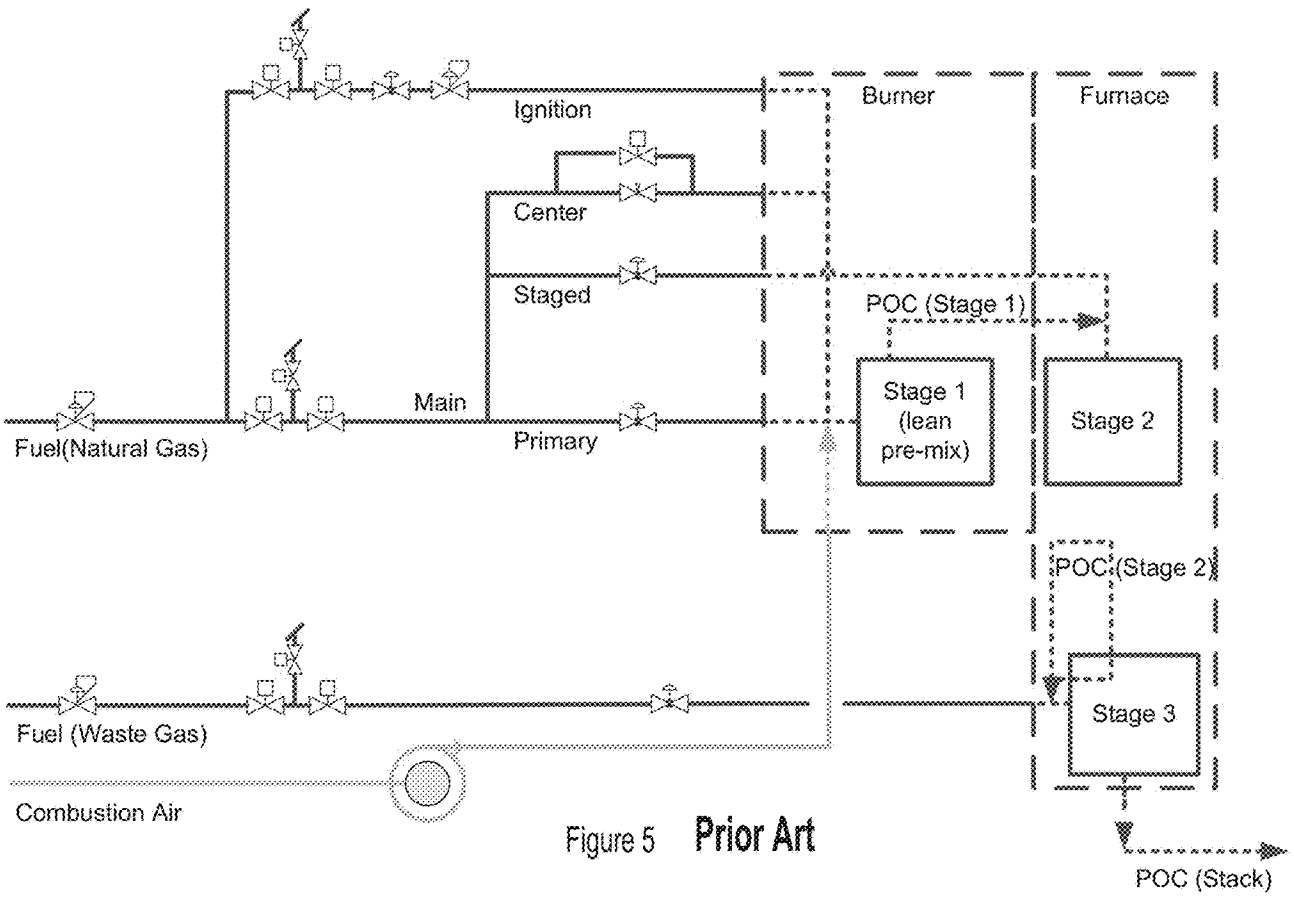
Figure 5 Prior Art
FIG. 5 is a flow diagram schematically illustrating the operation of a heating system in the prior art with staged fuel, without FGR, and with waste gas being part of the staged fuel.

FIG. 5 is a flow diagram of a variation of the prior art heating system in FIG. 3, wherein waste gas provides a portion the fuel source to the heating system for a third stage. In one embodiment, the amount of waste gas ranges from zero (0%) to 35% total fuel to the system. The maximum proportion of waste gas is related to the amount of non-combustible constituents contained within the waste gas constituents, and the value of total fuel may vary from the proportion indicated above. As shown, the waste gas is employed as part of the staged fuel system with the waste gas being directed to the third stage, and the POC from the second stage is induced to the third stage. All of the POC is directed to the exhaust stack.

Figure 6:
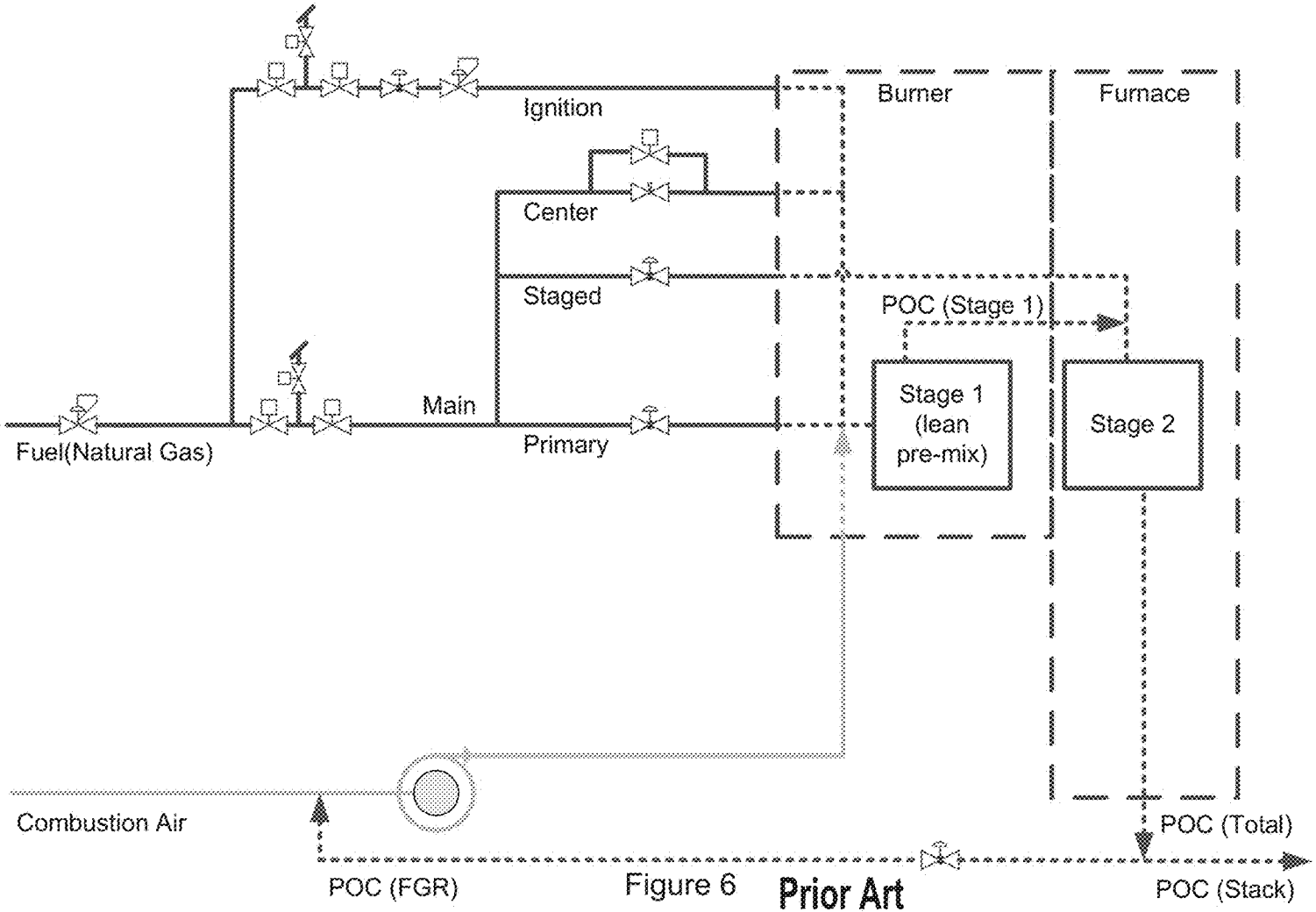
FIG. 6 is a flow diagram schematically illustrating the operation of a heating system in the prior art with staged fuel and with FGR.

FIG. 6 is a flow diagram of a variation of the prior art heating system in FIG. 3, but with flue gas recirculation ("FGR"). A portion of the POC is recirculated and mixed with the combustion air for subsequent mixing with the fuel source for a fuel lean mix to the primary stage. The amount of FGR that is recirculated typically ranges from 15 to 30% of the total POC from the system.

Figure 7:
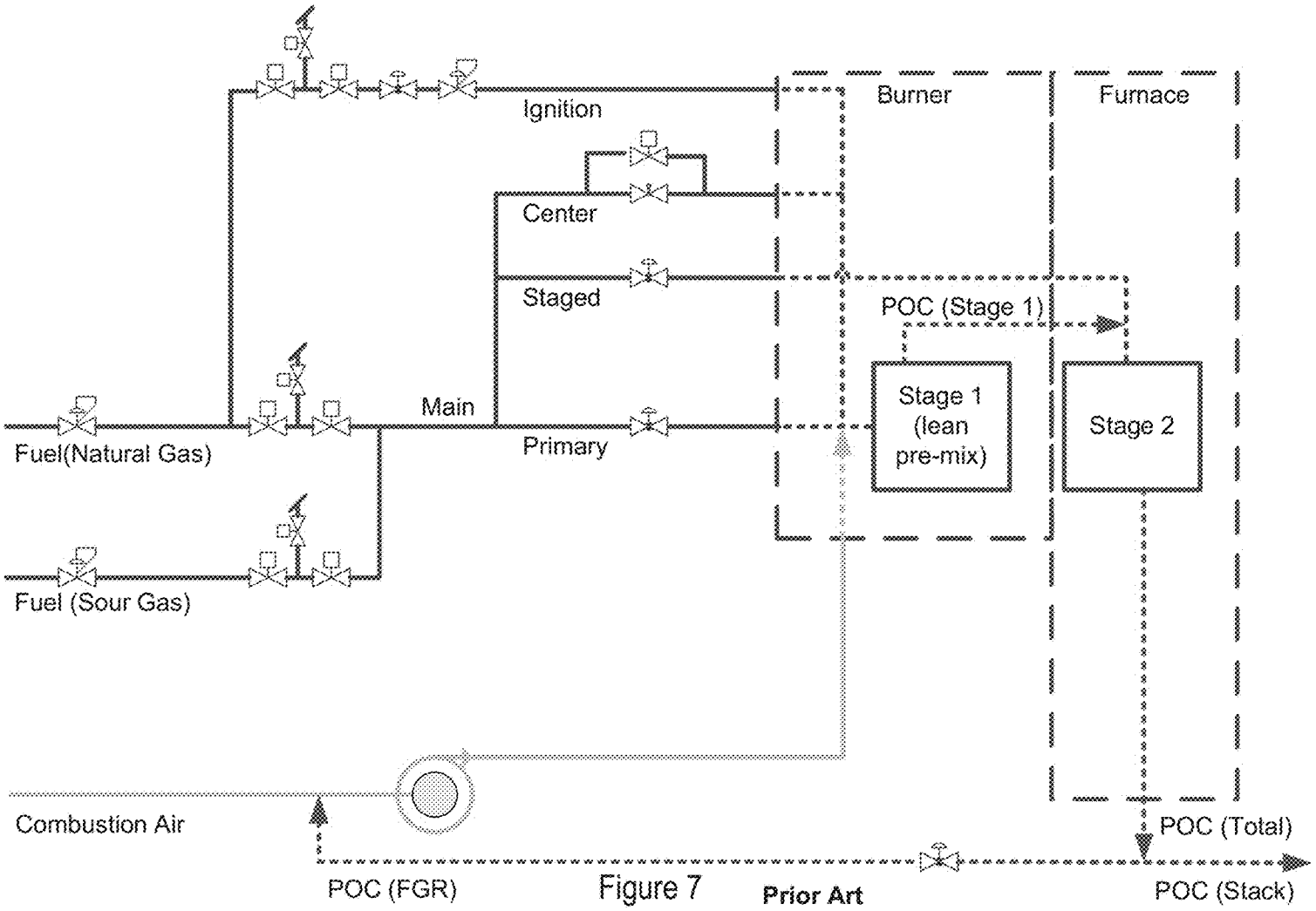
Figure 7 Prior Art
FIG. 7 is a flow diagram schematically illustrating the operation of a heating system in the prior art with staged fuel, with FGR, and with the fuel system comprising natural gas and sour gas.

FIG. 7 is a flow diagram of a variation of the prior art heating system in FIG. 5, wherein sour gas provides a portion the total fuel source to both stages of the heating system. In one embodiment, the amount of sour gas ranges from zero (0%) to 100% total fuel to the system.

Figure 8:
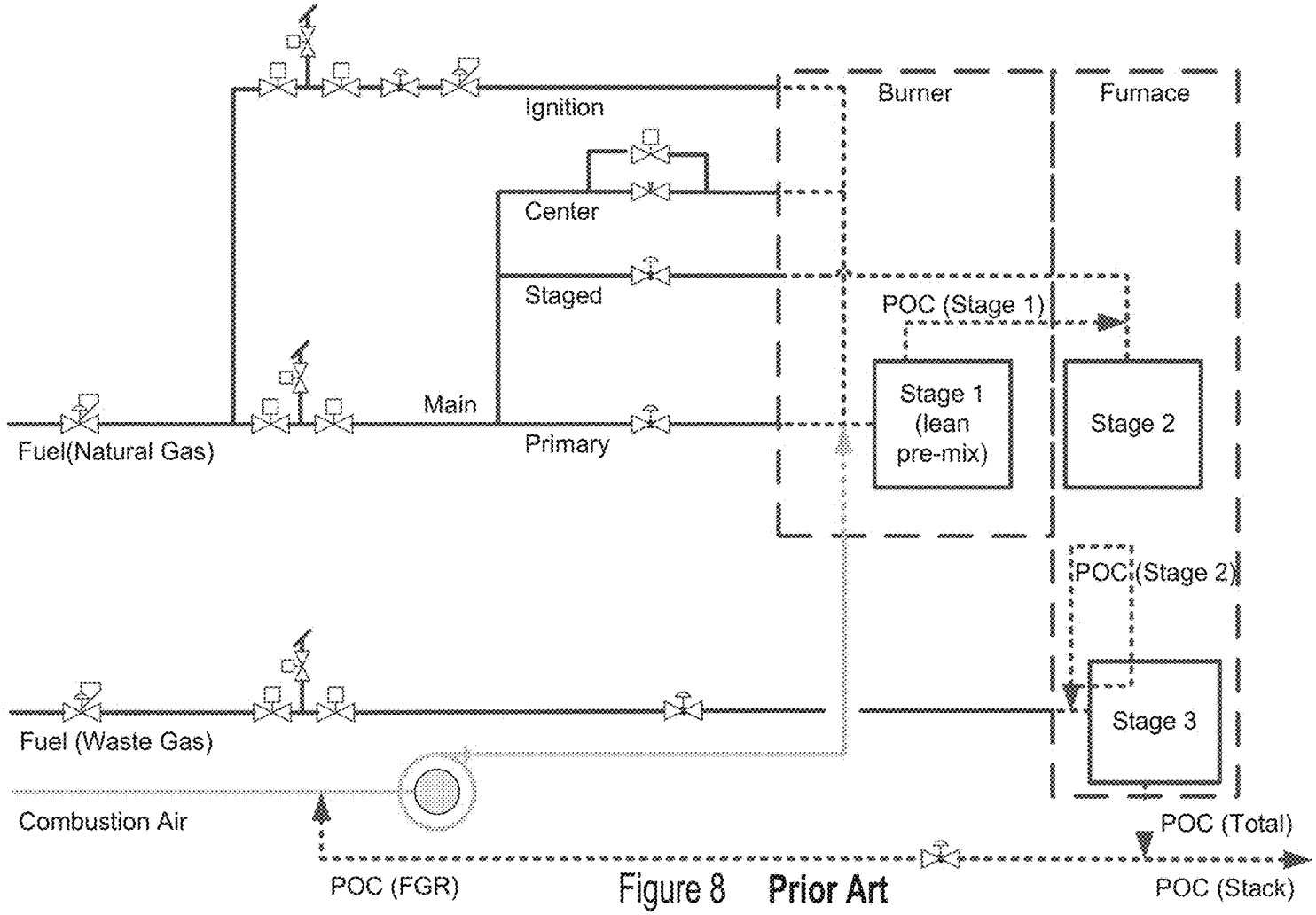
Figure 8 Prior Art
FIG. 8 is a flow diagram schematically illustrating the operation of a heating system in the prior art with staged fuel, with FGR, and with waste gas being part of the staged fuel.

FIG. 8 is a flow diagram of a variation of the prior art heating system in FIG. 5, with flue gas recirculation ("FGR") and waste gas providing a portion the fuel source to the third stage. A portion of the POC is recirculated and mixed with the combustion air for subsequent mixing with the fuel source for a fuel lean mix to the primary stage. The amount of FGR that is recirculated ranges from zero (0%) to 30% of the total POC from the system.

Figure 10:
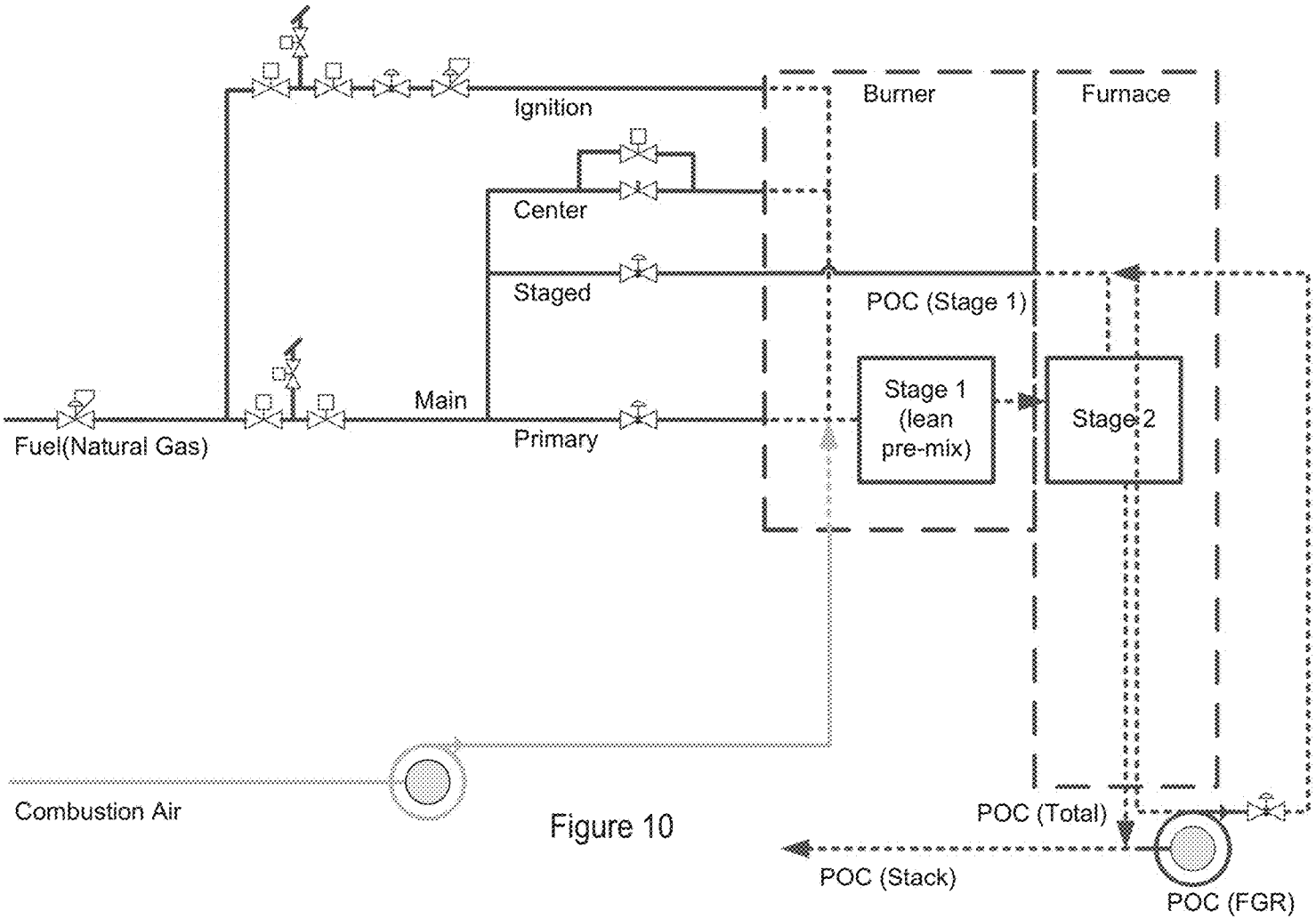
FIG. 10 is a flow diagram schematically illustrating the operation of a heating system according to one embodiment with staged fuel, which system is a retrofit of the heating system of FIG. 3.

FIG. 10 is a flow diagram schematically illustrating a retrofit of the heating system of FIG. 3, with a portion of the POC being recirculated and mixed with the secondary fuel, for injection into the secondary stage.

Figure 11:
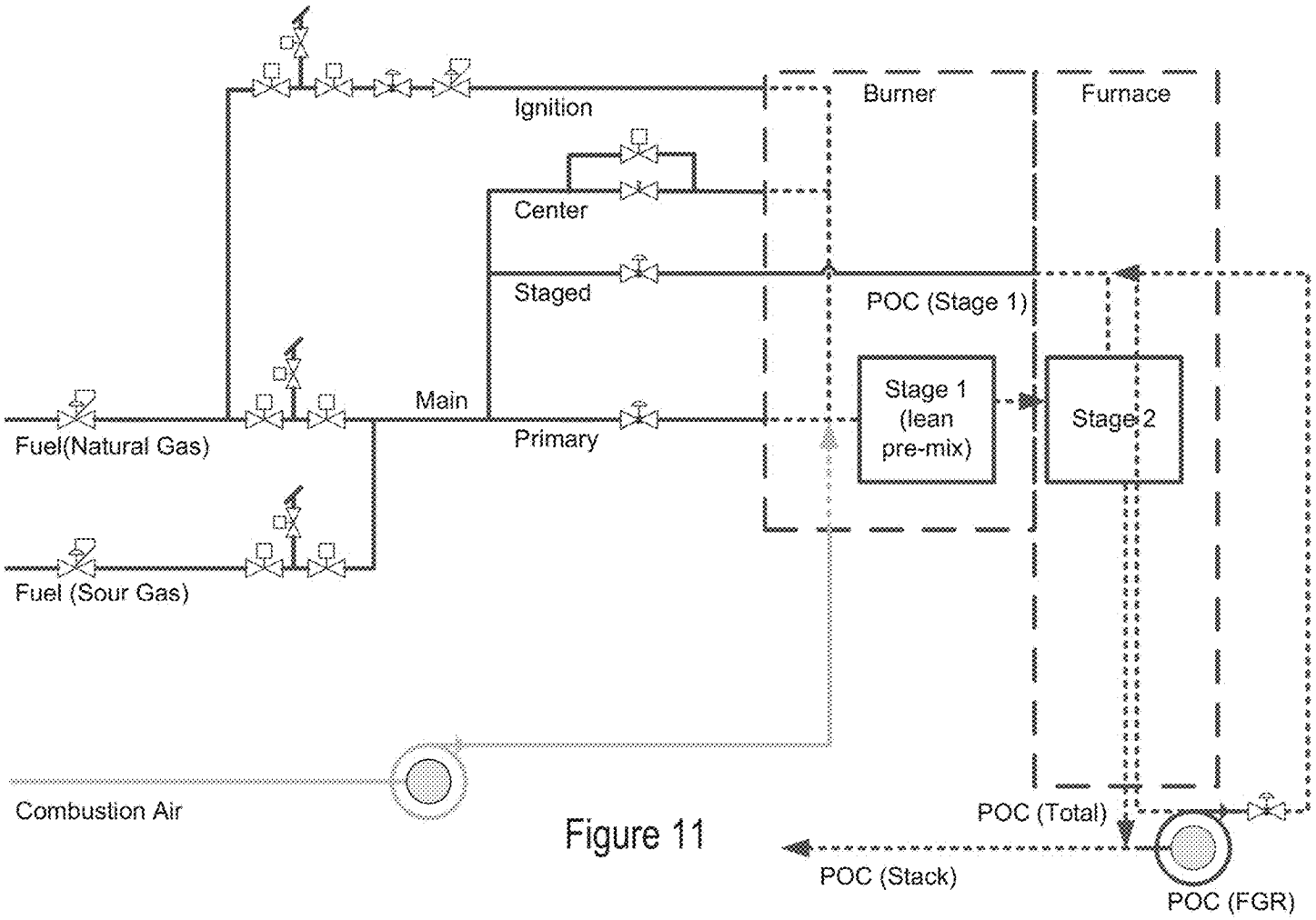
FIG. 11 is a flow diagram schematically illustrating the operation of a heating system according to another embodiment with staged fuel and a fuel system including a sour gas feed, which system is a retrofit of the heating system of FIG. 4.

FIG. 11 is a flow diagram schematically illustrating another retrofit of a prior art heating system, the system in FIG. 4. A portion of the POC is recirculated and pre-mixed with the fuel for feeding into the secondary stage.

Figure 9:
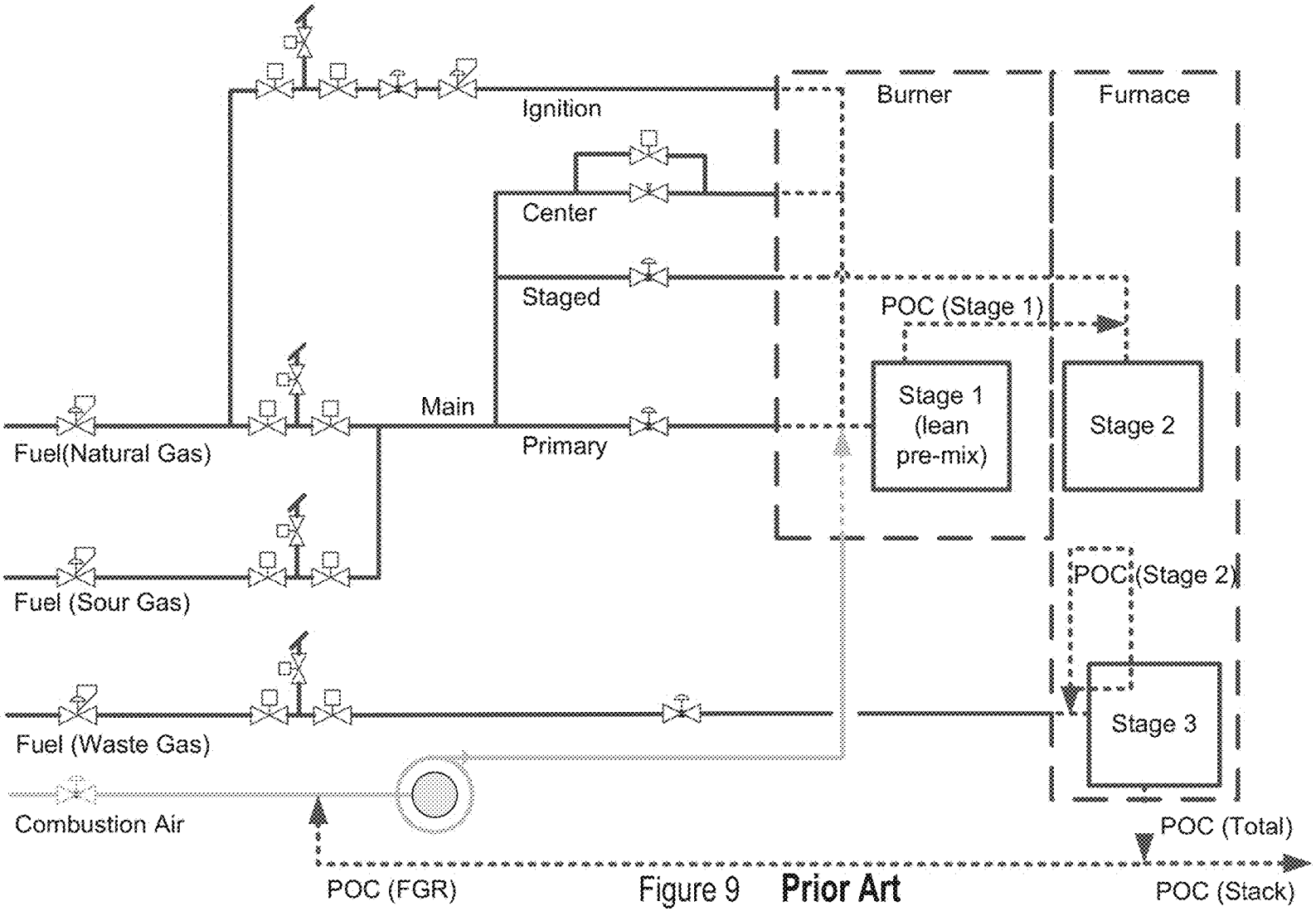
Figure 9 Prior Art
FIG. 9 is a flow diagram schematically illustrating the operation of a heating system in the prior art with staged fuel, with FGR, with the fuel system comprising natural gas, sour gas, and waste gas, and with waste gas being part of the staged fuel.
Figure 12:
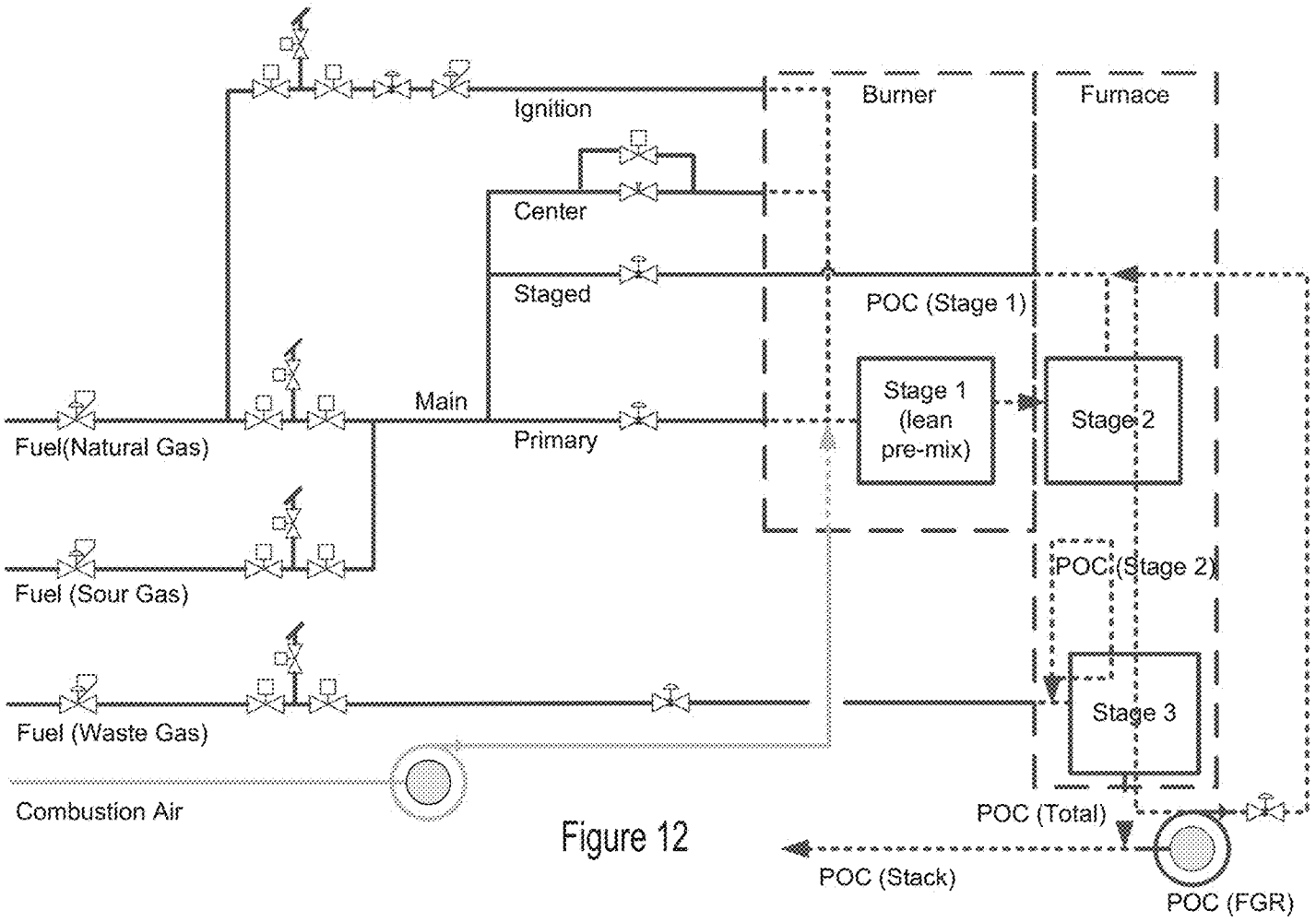
FIG. 12 is a flow diagram schematically illustrating the operation of a heating system according to another embodiment with staged fuel and a fuel system including a sour gas and a waste gas feed, which system is a retrofit of the heating system of FIG. 9.

FIG. 12 is a flow diagram schematically illustrating another retrofit. The prior art heating system of FIG. 9 is retrofitted for a portion of the POC is recirculated as flue gas recirculation. The FGR is premixed with a fuel stream in a pre-mixer and introduced into the furnace through secondary injection ports.

Figure 13:
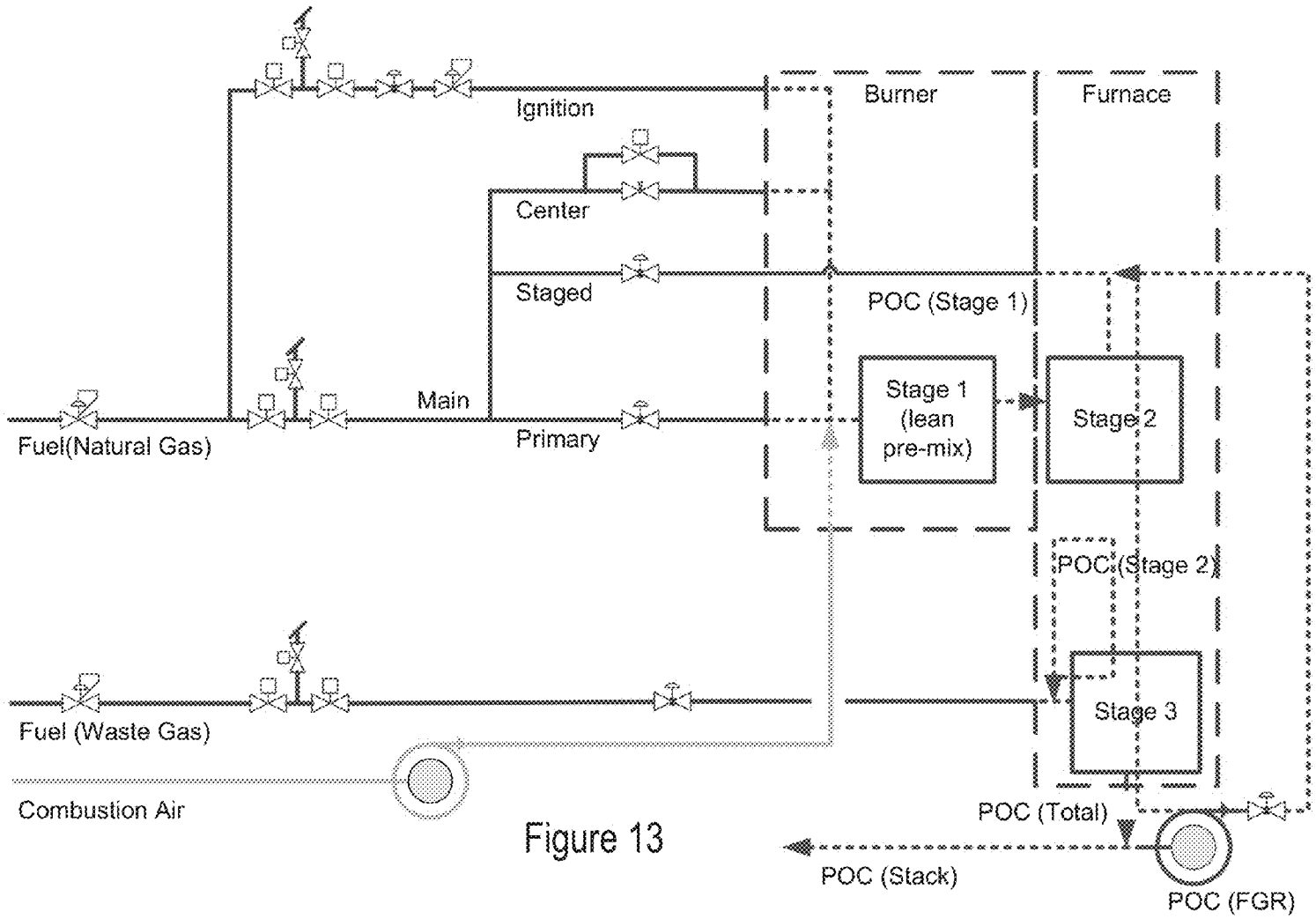
FIG. 13 is a flow diagram schematically illustrating the operation of a heating system according to another embodiment with staged fuel and a fuel system including a waste gas feed, which system is a retrofit of the heating system of FIG. 5.

FIG. 13 is a flow diagram schematically illustrating a retrofit of the prior art heating system of FIG. 5. A portion of the POC from the third stage is recirculated. The FGR is pre-mixed with the fuel for feeding into the secondary stage.

The description sets forth the best mode of carrying out the invention, and describes the invention so as to enable a person skilled in the art to make and use the invention, by presenting examples of elements recited in the claims. The patentable scope of the invention is defined by the claims, and may include other examples that occur to those skilled in the art. Such other examples, which may be available either before or after the application filing date, are intended to be within the scope of the claims if they have structural or method elements that do not differ from the literal language of the claims, or if they have equivalent structural or method elements with insubstantial differences from the literal language of the claims.

For the avoidance of doubt, the present application includes the subject-matter defined in the following numbered paragraphs:

Claim 1. A method for operating a furnace system with a reduced NOx emission, the furnace system is equipped with a combustion chamber, a premix staged combustion burner, a flue, a plurality of staged fuel injectors, an injection apparatus, and a reactant supply and control system, the method comprising: feeding a fuel stream and an air stream to the premix staged combustion burner, wherein the fuel and air streams are mixed to form a first fuel air mixture at a fuel to air equivalence ratio of less than 1, and wherein the first fuel air mixture is free of recirculated flue gas (RFG); injecting the first fuel air mixture via at least a primary injector into a primary combustion zone of the combustion chamber, wherein the first fuel air mixture is substantially combusted forming primary products of combustion ("POC"); introducing the primary POC into a secondary combustion zone of the combustion chamber; feeding a second fuel and a stream of recirculated flue gas (RFG) to a pre-mixer, wherein the second fuel and recirculated flue gas streams are mixed to form a second RFG fuel mixture; injecting the second RFG fuel mixture into the secondary combustion zone of the combustion chamber via the plurality of staged fuel injectors, wherein the second RFG fuel mixture is substantially combusted and mixed with the primary POC forming flue gas POC; recirculating a portion of the flue gas POC for use as the RFG for mixing with the second fuel to form the second RFG fuel mixture; whereby the injection of the second RFG fuel mixture into the secondary combustion zone of the combustion chamber results in a reduction of temperature in the combustion chamber for the NOx emission to be less than 5 ppm on a dry gas volumetric basis corrected to 3% $O_2$ (<5 ppm at 3% $O_2$, dry basis).

Claim 2. The method of claim 1, wherein the fuel for forming the first fuel air mixture has a higher heating value of 500 to 1200 Btu/scf.

Claim 3. The method of claim 2, wherein the fuel for forming the first fuel air mixture has a higher heating value of 900 to 1180 Btu/scf.

Claim 4. The method of claim 1, wherein the second RFG fuel mixture is substantially combusted forming a secondary POC, for subsequent mixing with the primary POC forming the flue gas POC.

Claim 5. The method of claim 1, wherein the second RFG fuel mixture is mixed with the primary POC prior to being substantially combusted to form the flue gas POC.

Claim 6. The method of claim 1, wherein the second RFG fuel mixture is injected into the secondary combustion zone of the combustion chamber via 3 to 8 staged fuel injectors.

Claim 7. The method of claim 1, wherein the second RFG fuel mixture is injected into the secondary combustion zone of the combustion chamber via 4 to 6 staged fuel injectors.

Claim 8. The method of claim 1, wherein the plurality of staged fuel injectors are circumferentially arranged adjacent to and around the premix staged combustion burner.

Claim 9. The method of claim 1, wherein the injection apparatus is configured to inject an unignited mixture of the second fuel and flue gas into the combustion chamber at a controlled volume ratio for the flue gas POC to have a NOx concentration of <5 ppm on a dry gas volumetric basis corrected to 3% $O_2$.

Claim 10. The method of claim 1, wherein the injection apparatus is configured to inject an unignited mixture of a secondary fuel and flue gas into the combustion chamber at a controlled volume ratio for the products of combustion to have a NOx concentration of <3 ppm on a dry gas volumetric basis corrected to 3% $O_2$ (<3 ppm at 3% $O_2$, dry basis).

Claim 11. The method of claim 10, wherein the secondary fuel has a higher heating value of 500 to 1200 Btu/scf.

Claim 12. The method of claim 11, wherein the secondary fuel has a higher heating value of 900 to 1180 Btu/scf.

Claim 13. The method of claim 1, wherein the injection apparatus is configured to inject an unignited mixture of a secondary fuel and flue gas into the combustion chamber at a volume ratio of secondary fuel to flue gas of 1:4 to 1:20.

Claim 14. The furnace system of claim 13, wherein the injection apparatus is configured to inject an unignited mixture of a secondary fuel and flue gas into the combustion chamber at a volume ratio of secondary fuel to flue gas of 1:5 to 1:10.

Claim 16. A method of retrofitting a furnace system equipped with a combustion chamber and a steam generator employing at least a fired burner with an existing flue gas recirculation system, wherein a recirculated flue gas (RFG) is injected with a fuel stream into a primary stage of the burner, the retrofit is to reduce NOx emission to less than 5 ppm at 3% $O_2$, dry basis, the method comprising: configuring the existing flue gas recirculation system to include a pre-mixer; routing the RFG from the steam generator flue to the pre-mixer for mixing with a portion of the fuel stream forming a second RFG fuel mixture; routing the secondary RFG fuel mixture to an existing secondary stage of the burner via a plurality of injectors for the injection of the second RFG fuel mixture; whereby the injection of the second RFG fuel mixture into the plurality of injector ports results in a reduction of temperature for the NOx emission to be less than 5 ppm at 3% $O_2$, dry basis.

Claim 17. The method of claim 16, further comprising configuring the plurality of injectors to inject an unignited mixture of a secondary fuel and flue gas into the combustion chamber at a volume ratio of secondary fuel to flue gas of 1:5 to 1:10.

Claim 18. The method of claim 16, further comprising configuring the plurality of injectors to inject an unignited mixture of a secondary fuel and flue gas into the combustion chamber at a controlled volume ratio for the products of combustion to have a NOx concentration of <3 ppm on a dry gas volumetric basis corrected to 3% $O_2$ (<3 ppm at 3% $O_2$, dry basis).

Claim 19. The method of claim 16, further comprising configuring the plurality of injectors to inject the second RFG fuel mixture into a secondary combustion zone of the combustion chamber via 3 to 8 staged fuel injectors.

Claim 20. The method of claim 16, further comprising configuring the plurality of injectors to inject the second RFG fuel mixture into a secondary combustion zone of the combustion chamber via 4 to 6 staged fuel injectors.

The invention claimed is:

1. A furnace system comprising:

a structure defining a combustion chamber;

sources of primary fuel, combustion air, and secondary fuel, wherein the primary fuel is natural gas and the secondary fuel is natural gas;

a premix staged combustion burner having at least a port facing into the combustion chamber;

a flue that conveys products of combustion (POC) from the combustion chamber;

a gas pre-mixer for receiving the secondary fuel and the POC, wherein the secondary fuel and the POC are mixed in the gas pre-mixer to form an unignited mixture of the secondary fuel and the POC, and wherein the gas pre-mixer does not receive combustion air;

a plurality of staged fuel injectors configured to inject the unignited mixture of the secondary fuel and the POC into the combustion chamber through the plurality of staged fuel injectors such that a diffuse combustion zone is created within the combustion chamber downstream of the plurality of staged fuel injectors in which temperatures are too low for thermal formation of oxides of nitrogen ($NO_x$), wherein the diffuse combustion zone is formed by interaction of a secondary flame envelope downstream of the plurality of staged fuel injectors peripherally surrounding a primary flame envelope downstream of the premix staged combustion burner, and wherein the plurality of staged fuel injectors is configured to inject the unignited mixture of the secondary fuel and the POC into the combustion chamber at a controlled volume ratio for the POC to have a $NO_x$ concentration of <5 ppm on a dry gas volumetric basis corrected to 3% $O_2$; and a reactant supply and control system including (a) a primary fuel supply line, (b) a primary fuel control valve for conveying the primary fuel from the primary fuel source to the premix staged combustion burner, (c) a combustion air supply line, (d) a combustion air blower, and (e) a combustion air control valve or a combustion air adjustable speed controller for conveying the combustion air from the combustion air source to the premix staged combustion burner for mixing with the primary fuel, (f) a secondary fuel supply line and (g) a secondary fuel control valve for conveying the secondary fuel from the secondary fuel source to the gas pre-mixer, (h) a POC supply line, (i) a POC blower, and (j) a POC control valve or a POC adjustable speed controller for conveying the POC from the flue to the gas pre-mixer for mixing with the secondary fuel.

2. The furnace system of claim 1, wherein the port of the premix staged combustion burner is for injection of a mixture of primary fuel and the combustion air, and at least one of the plurality of staged fuel injectors is for injection of the unignited mixture of the secondary fuel and the POC.

3. The furnace system of claim 1, wherein the combustion air is provided to the premix staged combustion burner at a sufficient rate for the POC to have an oxygen concentration ranging from 0.4 to 3% on a wet basis.

4. The furnace system of claim 3, wherein the combustion air is provided to the premix staged combustion burner at a sufficient rate for the POC to have an oxygen concentration ranging from 0.75 to 1.5% on a wet basis.

5. The furnace system of claim 1, wherein the plurality of staged fuel injectors is configured to inject the unignited mixture of the secondary fuel and the POC into the combustion chamber at a controlled volume ratio for the POC to have a $NO_x$ concentration of <3 ppm on a dry gas volumetric basis corrected to 3% $O_2$ (<3 ppm at 3% $O_2$, dry basis).

6. The furnace system of claim 1, wherein the plurality of staged fuel injectors is configured to inject the unignited mixture of the secondary fuel and the POC into the combustion chamber at a volume ratio of the secondary fuel to the POC of 1:4 to 1:20.

7. The furnace system of claim 6, wherein the plurality of staged fuel injectors is configured to inject the unignited mixture of the secondary fuel and the POC into the combustion chamber at a volume ratio of the secondary fuel to the POC of 1:5 to 1:10.

8. The furnace system of claim 1, wherein the plurality of staged fuel injectors includes 3 to 8 staged fuel injectors, and wherein the plurality of staged fuel injectors is configured to inject the unignited mixture of the secondary fuel and the POC into the combustion chamber through the 3 to 8 staged fuel injectors.

9. The furnace system of claim 1, wherein the plurality of staged fuel injectors includes 4 to 6 staged fuel injectors, and wherein the plurality of staged fuel injectors is configured to inject the unignited mixture of the secondary fuel and the POC into the combustion chamber through the 4 to 6 staged fuel injectors.

10. The furnace system of claim 1, wherein the primary fuel has a higher heating value of 500 to 1200 Btu/scf.

11. The furnace system of claim 10, wherein the primary fuel has a higher heating value range of 900 to 1180 Btu/scf.

12. The furnace system of claim 1, wherein the secondary fuel has a higher heating value of 500 to 1200 Btu/scf.

13. The furnace system of claim 1, wherein the secondary fuel has a higher heating value of 900 to 1180 Btu/scf.

14. The furnace system of claim 1, wherein the primary fuel and the secondary fuel have different higher heating values.

15. The furnace system of claim 1, wherein the primary fuel and the secondary fuel are configured to have a volumetric ratio resulting in a primary zone adiabatic flame temperature less than 2600° F. (1427° C.).

16. The furnace system of claim 15, wherein the primary fuel and the secondary fuel are configured to have a volumetric ratio resulting in a primary zone adiabatic flame temperature less than 2500° F. (1371° C.).

17. The furnace system of claim 1, wherein flue gas recirculation ranges from 15 to 30% of the POC.

18. A furnace system comprising:

a structure defining a combustion chamber;

sources of primary fuel, combustion air, and secondary fuel, wherein the primary fuel is natural gas and the secondary fuel is natural gas, and wherein the primary fuel and secondary fuel each has a higher heating value of from 500 to 1200 Btu/scf, and wherein the primary fuel and the secondary fuel are configured to have a volumetric ratio resulting in a primary zone adiabatic flame temperature less than 2600° F.;

a premix staged combustion burner having at least a port facing into the combustion chamber;

a flue that conveys products of combustion (POC) from the combustion chamber;

a gas pre-mixer for receiving the secondary fuel and the POC, wherein the secondary fuel and the POC are mixed in the gas pre-mixer to form an unignited mixture of the secondary fuel and the POC, and wherein the gas pre-mixer does not receive combustion air;

a plurality of staged fuel injectors each having a port facing into the combustion chamber, wherein the plurality of staged fuel injectors includes at least 3 staged fuel injectors configured to inject the unignited mixture of the secondary fuel and the POC into the combustion chamber through the at least 3 staged fuel injectors such that a diffuse combustion zone is created downstream of the at least 3 staged fuel injectors in which temperatures are too low for thermal formation of oxides of nitrogen ($NO_x$), wherein the diffuse combustion zone is formed by interaction of a secondary flame envelope downstream of the plurality of staged fuel injectors peripherally surrounding a primary flame envelope downstream of the premix staged combustion burner, and wherein the plurality of staged fuel injectors is configured to inject the unignited mixture of the secondary fuel and the POC into the combustion chamber at a controlled volume ratio for the POC to have a $NO_x$ concentration of <5 ppm on a dry gas volumetric basis corrected to 3% $O_2$; and a reactant supply and control system including (a) a primary fuel supply line, (b) a primary fuel control valve for conveying the primary fuel from the primary fuel source to the premix staged combustion burner, (c) a combustion air supply line, (d) a combustion air blower, (e) a combustion air control valve or a combustion air adjustable speed controller for conveying the combustion air from the combustion air source to the premix staged combustion burner for mixing with the primary fuel, (f) a secondary fuel supply line, (g) a secondary fuel control valve for conveying the secondary fuel from the secondary fuel source to the gas pre-mixer, (h) a POC supply line, (i) a POC blower, and (j) a POC control valve or a POC adjustable speed controller for conveying the POC from the flue to the gas pre-mixer for mixing with the secondary fuel.

19. The furnace system of claim 18, wherein the plurality of staged fuel injectors is configured to inject the unignited mixture of the secondary fuel and the POC into the combustion chamber at a volume ratio of the secondary fuel to the POC of 1:4 to 1:20.

20. The furnace system of claim 18, wherein the staged fuel injectors are circumferentially arranged adjacent to and around the premix staged combustion burner.

21. The furnace system of claim 18, wherein flue gas recirculation ranges from 15 to 30% of the POC.

* * * * *